US010313784B2

(12) United States Patent
Geng

(10) Patent No.: US 10,313,784 B2
(45) Date of Patent: Jun. 4, 2019

(54) INTEGRALLY-DESIGNED BONE CONDUCTION DRIVER

(71) Applicant: Jun Geng, Guangdong (CN)

(72) Inventor: Jun Geng, Guangdong (CN)

( * ) Notice: Subject to any disclaimer, the term of this patent is extended or adjusted under 35 U.S.C. 154(b) by 0 days.

(21) Appl. No.: 15/793,674

(22) Filed: Oct. 25, 2017

(65) Prior Publication Data

US 2019/0069075 A1 Feb. 28, 2019

(30) Foreign Application Priority Data

Aug. 31, 2017 (CN) ..... 2017 2 11086005 U

(51) Int. Cl.
*H04R 9/06* (2006.01)
*H04R 1/28* (2006.01)
(Continued)

(52) U.S. Cl.
CPC ..... *H04R 1/288* (2013.01); *H04R 9/047* (2013.01); *H04R 9/06* (2013.01); *H04R 25/606* (2013.01);
(Continued)

(58) Field of Classification Search
CPC ..... H04R 1/2807; H04R 9/025; H04R 9/06; H04R 9/066; H04R 9/08; H04R 11/02;
(Continued)

(56) References Cited

U.S. PATENT DOCUMENTS 5,335,284 A * 8/1994 Lemons ..... H04R 9/066 381/152
6,208,237 B1 * 3/2001 Saiki ..... H04M 1/03 340/388.1
(Continued)

FOREIGN PATENT DOCUMENTS

CN 106507234 A 3/2017

*Primary Examiner* — Huyen D Le
(74) *Attorney, Agent, or Firm* — Hamre, Schumann, Mueller & Larson, P.C.

(57) ABSTRACT

An integrally-designed bone conduction driver relates to the technical field of headsets using bond conduction speaker technologies, and overcomes technical disadvantages of existing bone conduction speakers, namely, complex processes and poor comfortability when they are worn. The bone conduction driver includes a vibrating plate, a voice coil, an elastic piece, a magnet, a washer, and a cup holder, where a wire outlet end of the voice coil is fixed on an inner side face of the vibrating plate; the vibrating plate is connected to the cup holder by using the elastic piece as an elastic support; the elastic piece includes an inner ring part, at least two outer arc parts that are concentric with and in clearance fit with the inner ring part, and at least two connection parts connecting tail ends of the outer arc parts to the inner ring part; and the voice coil is integrally combined with the inner side face of the vibrating plate. Meanwhile, an additional elastic piece and an additional support that support each other and that fix the voice coil are not needed between the vibrating plate and the cup holder, so that the process is simple and easy, there are fewer parts, and the combination is simple. Not only the weight is reduced, but also the sensitivity and the kinetic energy are increased, and the shape is special and aesthetic.

3 Claims, 3 Drawing Sheets

(51) Int. Cl.
*H04R 25/00* (2006.01)
*H04R 9/04* (2006.01)

(52) U.S. Cl.
CPC ..... *H04R 1/2807* (2013.01); *H04R 2225/67* (2013.01); *H04R 2400/03* (2013.01); *H04R 2460/13* (2013.01)

(58) Field of Classification Search
CPC ..... H04R 2225/67; H04R 2400/07; H04R 2440/05; H04R 2460/13; H04R 7/16; H04R 9/047; H04R 2400/03
USPC ..... 381/337, 151, 152, 386, 396, 403, 404, 381/412, 417, 420, 431
See application file for complete search history.

(56) References Cited

U.S. PATENT DOCUMENTS 6,477,257 B1 * 11/2002 Chang ..... H04R 9/08 381/355
6,490,363 B1 * 12/2002 Liu ..... H04R 9/06 381/398
6,618,487 B1 * 9/2003 Azima ..... H04R 1/24 381/152
2015/0170633 A1 6/2015 Nakagawa et al.

* cited by examiner

INTEGRALLY-DESIGNED BONE CONDUCTION DRIVER

BACKGROUND

Technical Field

The present invention relates to the technical field of headsets using bond conduction speaker technologies.

Related Art

Bone conduction is a sound conduction manner. That is, sound is converted to mechanical vibrations at different frequencies, and sound waves are transmitted through the skull, the bony labyrinths, the inner ear lymph, the spiral organs, the auditory nerves, and the auditory center. Currently, bone conduction speakers usually conduct sound directly by using facial cheekbones. Compared with a classic sound conduction manner in which sound waves are generated by using a vibrating diaphragm, in the bone conduction manner, multiple steps for transmitting sound waves are omitted, clear sound can be reconstructed in a noisy environment, and the sound waves are prevented from affecting other persons for being diffused in the air. Moreover, both ears may also be released, and the eardrums are not harmed.

However, existing bone conduction speakers have technical disadvantages including: complex processes, relatively large volumes, relatively large thicknesses, heaviness, and poor comfortability when they are worn.

SUMMARY

Based on the above, an objective of the present invention is to provide an integrally-designed bone conduction driver, to overcome technical disadvantages of existing bone conduction speakers, namely, complex processes and poor comfortability when they are worn.

To resolve technical problems raised in the present invention, the following technical solution is used:

An integrally-designed bone conduction driver includes a vibrating plate, a voice coil, an elastic piece, a magnet, a washer, and a cup holder, where the voice coil includes a tubular framework and a coil and a lead wire that are coiled on the framework, and a wire outlet end of the voice coil is fixed on an inner side face of the vibrating plate;

the vibrating plate is connected to the cup holder by using the elastic piece as an elastic support, the elastic piece includes an inner ring part, at least two outer arc parts that are concentric with and in clearance fit with the inner ring part, and at least two connection parts connecting tail ends of the outer arc parts to the inner ring part, and front ends of the outer arc parts and the inner ring part are respectively connected to the vibrating plate and the cup holder; and the magnet is fixed at an internal central position of the cup holder, the washer is fixed on the magnet in a gluing manner, the washer is coaxial with the magnet, and the washer is disposed in an inner cavity of the voice coil and in uniform clearance fit with the voice coil.

The vibrating plate includes a plate body having a diameter the same as that of the brim of the cup holder, a side of the plate body being provided with at least two fixed feet that are each fixedly connected to the front end of each outer arc part; and the inner ring part is attached to and fixedly connected to the brim of the cup holder, and the cup holder is a component of a magnetic circuit.

Holder supporting blocks correspondingly supporting the connection parts are disposed on an outer sidewall of the cup holder.

The cup holder is a tripod cup holder.

Beneficial effects of the present invention are as follows:

(1) In the present invention, a voice coil is integrally combined with an inner side face of a vibrating plate, and the vibrating plate is connected to a cup holder by using a particular elastic supporting structure, so that the process is simple and easy, the combination is simple, and an additional elastic piece and an additional support that support each other and fix the voice coil are not needed. The process is simple and easy, there are fewer parts, and the combination is simple.

(2) The entire thickness of a bone conduction drive head is greatly reduced, so that not only the weight is reduced, but also the sensitivity and the kinetic energy are increased, and the shape is special and aesthetic.

(3) A conventional bone conduction driver is a voice coil without a framework, the assembly is complex, losses are easily caused, the bearing power is not high, and the service life is short. With regard to a voice coil with a framework provided in the present invention, not only a process is simplified, but also features, such as fatigue resistance and high-temperature resistance, of the voice coil are enhanced, so that the service life of the bone conduction driver is greatly prolonged.

(4) The elastic piece in the present invention is not a conventional elastic piece, and a central position of the elastic piece needs to be used to fix the voice coil or a special support, breaking the conventional fixation manner. The elastic piece is a sided-arc independent single sheet. The arc sheet is either fixed or moveable in a vertical direction, the elasticity is excellent, and the sequence is good.

(5) A conventional assembly manner in which the voice coil is fixed to a support is broken, the support is omitted, and the voice coil is directly mounted onto the vibrating plate. The assembly is simple and easy, and parts are combined precisely and stably.

(6) The cup holder is designed as a special tripod instead of a conventional cylinder, a support of the cup holder that is used to fix the elastic piece is removed, and a tripod of the cup holder and a round edge mesa are used to fix the elastic piece. With reference to (5), not only the entire weight of a product is reduced, but also the thickness of bone conduction is reduced, so that the product is more competitive in terms of design of a spatial structure.

DETAILED DESCRIPTION

A structure of the present invention is further described with reference to the accompanying drawings and specific preferred embodiments of the present invention.

Figure 1:
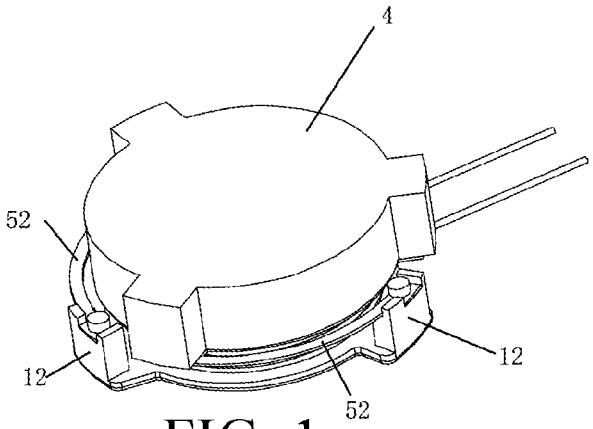
FIG. 1 is a schematic diagram 1 of a three-dimensional structure according to the present invention.
Figure 2:
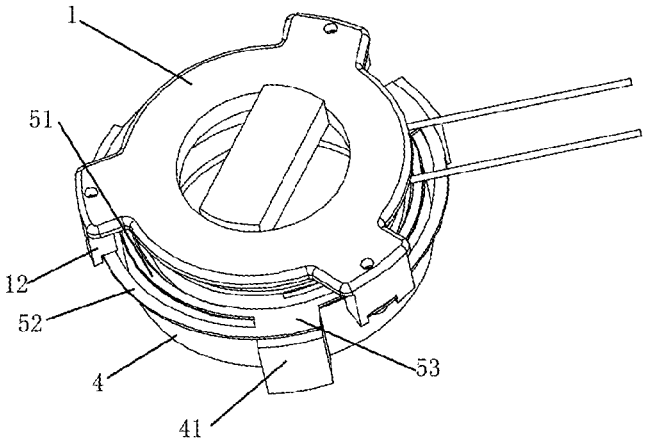
FIG. 2 is a schematic diagram 2 of a three-dimensional structure according to the present invention.
Figure 3:
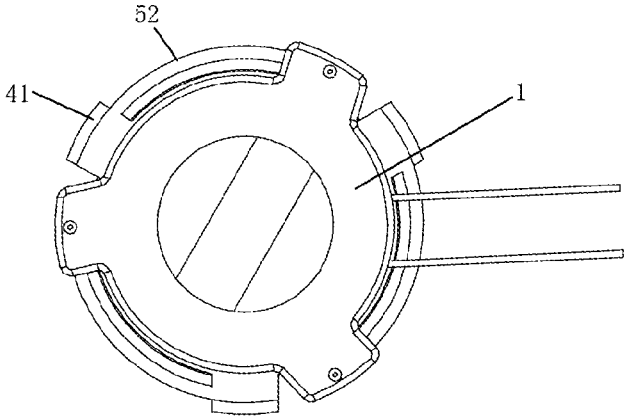
FIG. 3 is a schematic diagram of a top-view structure according to the present invention.
Figure 4:
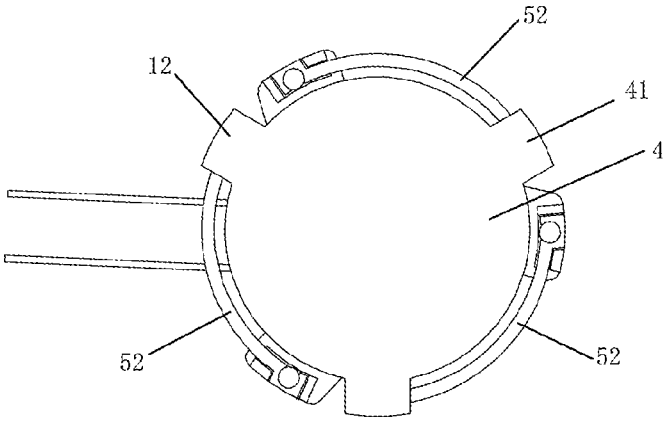
FIG. 4 is a schematic diagram of a bottom-view structure according to the present invention.
Figure 5:
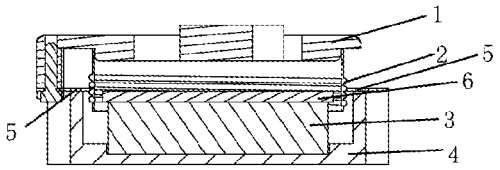
FIG. 5 is a schematic diagram of a cross-section structure according to the present invention.
Figure 6:
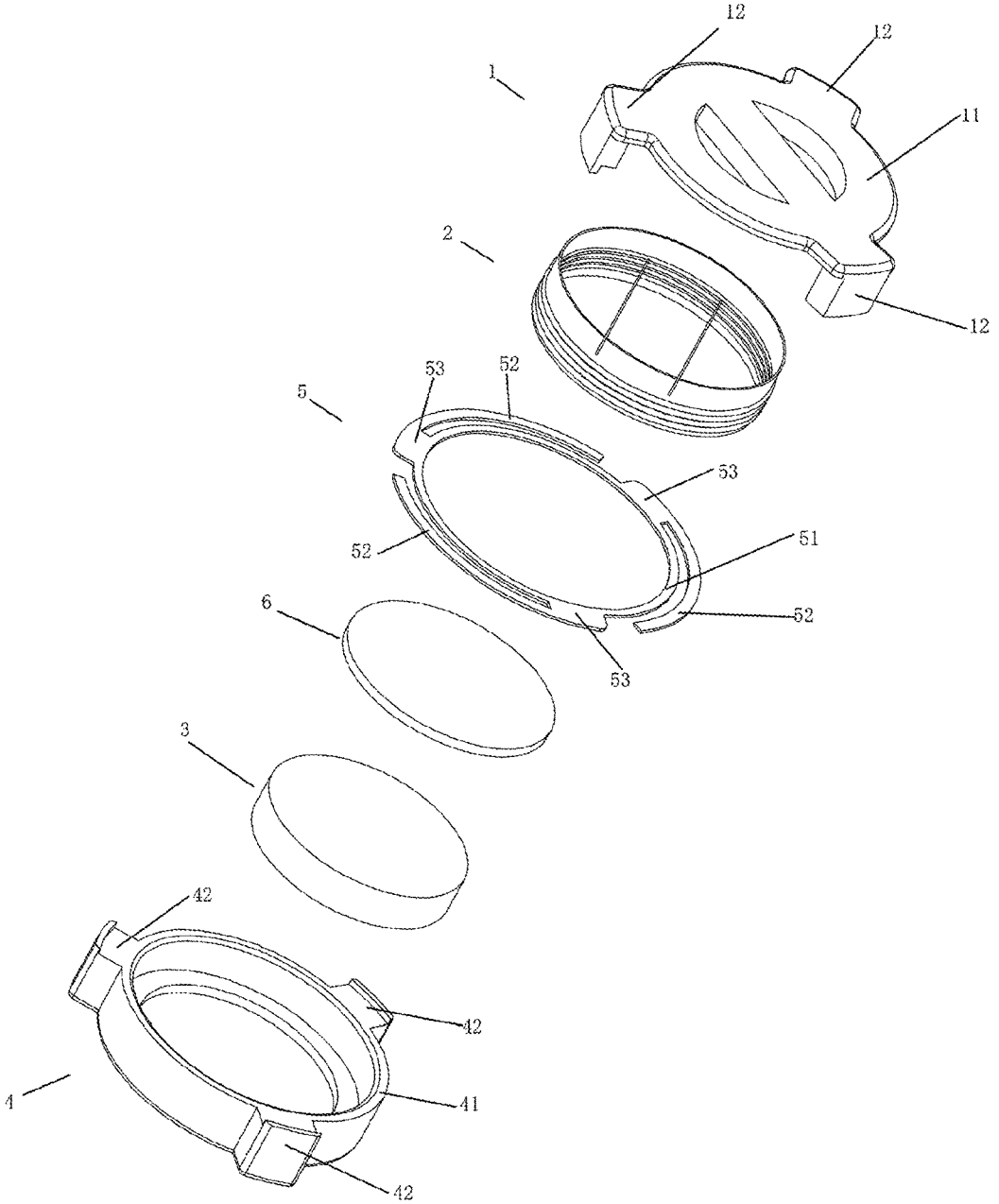
FIG. 6 is a schematic diagram of a three-dimensional structure according to the present invention.

Referring to FIG. 1 to FIG. 6, a bone conduction speaker in the present invention includes a vibrating plate 1, a voice coil 2, an elastic piece 5, a magnet 3, a washer 6, and a cup holder 4.

The voice coil 2 includes a tubular framework that is made of KSV and a coil and a lead wire that are coiled on the framework, to form a polyimide film oxygen-free copper high-temperature resistant voice coil having a good tone. One end of the framework is integrally combined with an inner side face of the vibrating plate 1, and the combination is simple.

The vibrating plate 1 is connected to the cup holder 4 by using the elastic piece 5 as an elastic support. The elastic piece 5 includes an inner ring part 51, at least two outer arc parts 52 that are concentric with and in clearance fit with the inner ring part 51, and at least two connection parts 53 connecting tail ends of the outer arc parts 52 to the inner ring part 51. The inner ring part 51, the outer arc parts 52, and the connection parts 53 are an integrated structure that is formed by punching a steel sheet. In a preferred solution, a quantity of the outer arc parts 52 is three, and the three outer arc parts 52 are evenly arranged on the periphery of the inner ring part 51.

For ease of connecting the vibrating plate 1 to the cup holder 4 by using the elastic piece 5, the vibrating plate 1 includes a plate body 11 having a diameter the same as that of the brim 41 of the cup holder 4, a side of the plate body 11 being provided with three fixed feet 12 that are each fixedly connected to the front end of each outer arc part 52. The inner ring part 51 is attached to and fixedly connected to the brim 41 of the cup holder 4. Holder supporting blocks 42 correspondingly supporting the connection parts 53 are disposed on an outer sidewall of the cup holder 4. During specific implementation, according to requirements, the front ends of the outer arc parts 52 may also be connected to the cup holder 4, and the inner ring part 51 is connected to the vibrating plate 1. The cup holder 4 is a tripod cup holder. The cup holder is not only a component of a magnetic circuit, but also an important part for fixing the elastic piece.

The magnet 3 is fixed at an internal central position of the cup holder 4, the washer 6 having good magnetoconductivity is fixed on the magnet 3 in a gluing manner, the washer 6 is coaxial with the magnet 3, and the washer 6 is disposed in an inner cavity of the voice coil 2 and in uniform clearance fit with the voice coil 2. In a uniform magnetic field, affected by an audio current, the voice coil 2 converts magnetic field energy to mechanical energy according to the principle of the left hand rule, and a sound signal is conducted to a human body by means of mechanical vibrations.

What is claimed is:

1. An integrally-designed bone conduction driver, comprising:

a vibrating plate, a voice coil, an elastic piece, a magnet, a washer, and a cup holder, wherein the voice coil comprises a tubular framework and a coil and a lead wire that are coiled on the framework;

a wire outlet end of the voice coil is fixed on an inner side face of the vibrating plate;

the vibrating plate is connected to the cup holder by using the elastic piece as an elastic support;

the elastic piece comprises an inner ring part, at least two outer arc parts that are concentric with and in clearance fit with the inner ring part, and at least two connection parts connecting tail ends of the outer arc parts to the inner ring part;

front ends of the outer arc parts and the inner ring part are respectively connected to the vibrating plate and the cup holder;

the magnet is fixed at an internal central position of the cup holder, the washer is fixed on the magnet in a gluing manner, the washer is coaxial with the magnet, and the washer is disposed in an inner cavity of the voice coil and in uniform clearance fit with the voice coil;

the vibrating plate comprises a plate body having a diameter the same as that of the brim of the cup holder, a side of the plate body being provided with at least two fixed feet that are each fixedly connected to the front end of each outer arc part; and the inner ring part is attached to and fixedly connected to the brim of the cup holder, and the cup holder is a component of a magnetic circuit.

2. The integrally-designed bone conduction driver according to claim 1, wherein holder supporting blocks correspondingly supporting the connection parts are disposed on an outer sidewall of the cup holder.

3. The integrally-designed bone conduction driver according to claim 1, wherein the cup holder is a tripod cup holder.

* * * * *